US007726280B2

(12) United States Patent
Nishimura et al.

(10) Patent No.: US 7,726,280 B2
(45) Date of Patent: Jun. 1, 2010

(54) INTAKE CHARGE-REGULATING APPARATUS FOR AN INTERNAL COMBUSTION ENGINE, AND ENGINE INCORPORATING SAME

(75) Inventors: Shin Nishimura, Saitama (JP); Kazuhito Hotta, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/284,498

(22) Filed: Sep. 23, 2008

(65) Prior Publication Data

US 2009/0084352 A1 Apr. 2, 2009

(30) Foreign Application Priority Data

Sep. 29, 2007 (JP) ..... 2007-256963

(51) Int. Cl.
*F02D 11/10* (2006.01)

(52) U.S. Cl. ..... 123/399; 123/337

(58) Field of Classification Search ..... 123/336, 123/337, 399, 472, 90.27, 90.31, 184.31, 123/198 E; 180/218, 219, 291
See application file for complete search history.

(56) References Cited

U.S. PATENT DOCUMENTS

| | | | | |
|---|---|---|---|---|
| 4,957,071 | A | 9/1990 | Matsuo et al. | |
| 5,490,573 | A * | 2/1996 | Hagiwara et al. | 180/68.1 |
| 5,785,027 | A | 7/1998 | Chabry | |
| 6,321,720 | B1 * | 11/2001 | Kashima | 123/470 |
| 6,758,299 | B2 * | 7/2004 | Ito | 180/291 |
| 7,147,075 | B2 * | 12/2006 | Tanaka et al. | 180/229 |
| 7,147,077 | B2 * | 12/2006 | Morii et al. | 180/291 |
| 7,185,630 | B2 * | 3/2007 | Takahashi et al. | 123/361 |
| 7,412,960 | B2 * | 8/2008 | Nishizawa | 123/198 E |
| 2003/0098004 | A1 | 5/2003 | Ohsuga et al. | |
| 2006/0006016 | A1 * | 1/2006 | Nishizawa | 180/219 |
| 2006/0231069 | A1 * | 10/2006 | Hanasato | 123/336 |
| 2007/0044757 | A1 * | 3/2007 | Suzuki | 123/339.23 |
| 2008/0184958 | A1 * | 8/2008 | Sato et al. | 123/336 |

FOREIGN PATENT DOCUMENTS

| | | |
|---|---|---|
| DE | 10 2006 011 679 A1 | 9/2006 |
| JP | 2001-263186 | 9/2001 |
| JP | 2002-256900 | 9/2002 |

* cited by examiner

*Primary Examiner*—Stephen K Cronin
*Assistant Examiner*—Johnny H Hoang
(74) *Attorney, Agent, or Firm*—Carrier, Blackman & Associates, P.C.; William D. Blackman; Joseph P. Carrier

(57) ABSTRACT

An intake charge regulating apparatus for an engine includes a throttle body having a throttle bore formed therein for communicating with an intake port, and a throttle valve for controlling flow through the throttle bore. A throttle-driving mechanism includes an electric motor and a transmission mechanism for decelerating a driving force of the electric motor and for transmitting the driving force to the throttle valve. A camshaft sprocket is fixed to an end portion of a camshaft, which is included in a valve train for driving intake and exhaust valves in a cylinder head to open and close. The throttle-driving mechanism is arranged opposite a side where the camshaft sprocket is located in an axis direction of the crankshaft. The electric motor is disposed between the throttle body and the cylinder head in top plan view.

16 Claims, 6 Drawing Sheets

INTAKE CHARGE-REGULATING APPARATUS FOR AN INTERNAL COMBUSTION ENGINE, AND ENGINE INCORPORATING SAME

CROSS-REFERENCE TO RELATED APPLICATIONS

The present application claims priority under 35 USC §119 based on Japanese Patent Application No. 2007-256963, filed on Sep. 29, 2007. The entire subject matter of this priority document is incorporated by reference herein.

BACKGROUND OF THE INVENTION

1. Field of the Invention

The present invention relates to an intake charge regulating apparatus for an engine including: a throttle body, which includes a throttle bore communicating with an intake port of a cylinder head constituting a part of an engine main body, and in which a throttle valve for controlling the opening of the throttle bore is placed; and a throttle driving mechanism including an electric motor for generating power for driving the throttle valve to open and close, as well as a transmission mechanism for decelerating the driving force of the electric motor, and for transmitting the resultant driving force to the throttle valve.

2. Background Art

Japanese Patent Application No. 2002-256900 discloses a V-type multi-cylinder engine of a type in which an electric motor, for generating power for driving throttle valves to open and close, is arranged in a middle portion between a paired banks.

The V-type multi-cylinder engine of the type disclosed by Japanese Patent Application No. 2002-256900 leads to constructing of an intake charge regulating apparatus in a larger size, because the electric motor is arranged separate from the engine main body.

The present invention has been made with the above-described condition taken into consideration. An object of the present invention is to provide an intake charge regulating apparatus for an engine, which is capable of being constructed in a smaller size.

For achieving the object, the present invention according to a first aspect, is characterized by an intake charge regulating apparatus for an engine including: a throttle body, which includes a throttle bore communicating with an intake port of a cylinder head constituting a part of an engine main body, and which a throttle valve for controlling the opening of the throttle bore is placed in; and throttle driving mechanism including an electric motor for generating power for driving the throttle valve to open and close, as well as a transmission mechanism for decelerating the driving force of the electric motor, and for transmitting the resultant driving force to the throttle valve. The intake charge regulating apparatus is characterized in that: a driven wheel constituting a part of a timing transmission mechanism for transmitting power coming from a crankshaft is fixed to an end portion of a camshaft included in a valve system for driving an intake and exhaust valves to open and close, the intake and exhaust valves being placed in the cylinder head in a way that the intake and exhaust valves are capable of opening and closing; the throttle driving mechanism is arranged in a side which is opposite to the side where the timing transmission mechanism is located in the axis direction of the crankshaft; and the electric motor is arranged between the throttle body and the cylinder head in a plan view.

The present invention according to a second aspect, in addition to the first aspect hereof, is characterized in that: the engine main body is formed into a V4 cylinder engine with a first and second banks which are arranged in a V shape; two throttle bodies including the throttle body are arranged to respectively correspond to two cylinders in the first bank, and the two throttle bodies are connected to each other in order that the two throttle bodies can constitute a first throttle body group; the other two throttle bodies arranged to respectively correspond to two cylinders in the second bank are connected to each other in order that the two throttle bodies can constitute a second throttle body group; the distance between the throttle bores of the two respective throttle bodies in the first throttle body group is set shorter than the distance between the throttle bores of the two throttle bodies in the second throttle body group; and the electric motor is placed in the first throttle body group.

The present invention according to a third aspect, in addition to the second aspect hereof, is characterized in that: the engine main body is mounted on a vehicle body frame of a motorcycle while arranged under an air cleaner and a fuel tank; and the electric motor is arranged under a space created between a cleaner case of the air cleaner and the fuel tank.

It should be noted that a rear bank BR according to an embodiment of the present invention corresponds to the first bank according to the present invention, and a front bank BF, to the second bank according to the present invention. Further, it should be noted that a driven sprocket 48R corresponds to the driven wheel according to the present invention.

The present invention according to the first aspect hereof makes it possible to place the electric motor close to the cylinder head to the maximum possible extent without consideration being given to interference which would otherwise occur between the electric motor and the timing transmission mechanism, and thus, to construct the intake charge regulating apparatus compactly. This is because the throttle driving mechanism is placed in a side which is opposite to the side where the timing transmission mechanism provided between the camshaft of the valve system and the crankshaft is placed in the axis direction of the crankshaft, and also because the electric motor as the throttle driving mechanism is arranged between the throttle body and the cylinder head in a plan view.

In addition, the present invention according to the second aspect hereof makes it possible to effectively arrange the electric motor in the space created by comparatively narrowing down the interval between the two throttle bodies. This is because the interval between the throttle bores of the two respective throttle bodies in the first throttle body group is set shorter than the interval between the throttle bores of the two respective throttle bodies in the second throttle body group, and also because the electric motor is placed in the first throttle body group.

The present invention according to the third aspect hereof makes it unnecessary to devise a scheme of arranging the structural members other than the electric motor in places that are not occupied by the electric motor, and thus, makes it possible to construct the intake charge regulating apparatus compactly. This is because the electric motor is arranged under the space created between the cleaner case of the air cleaner and the fuel tank.

DETAILED DESCRIPTION OF ILLUSTRATIVE EMBODIMENTS

Descriptions will be provided here-in-below for an embodiment of the present invention, the embodiment as shown in the accompanying drawings.

Figure 1:
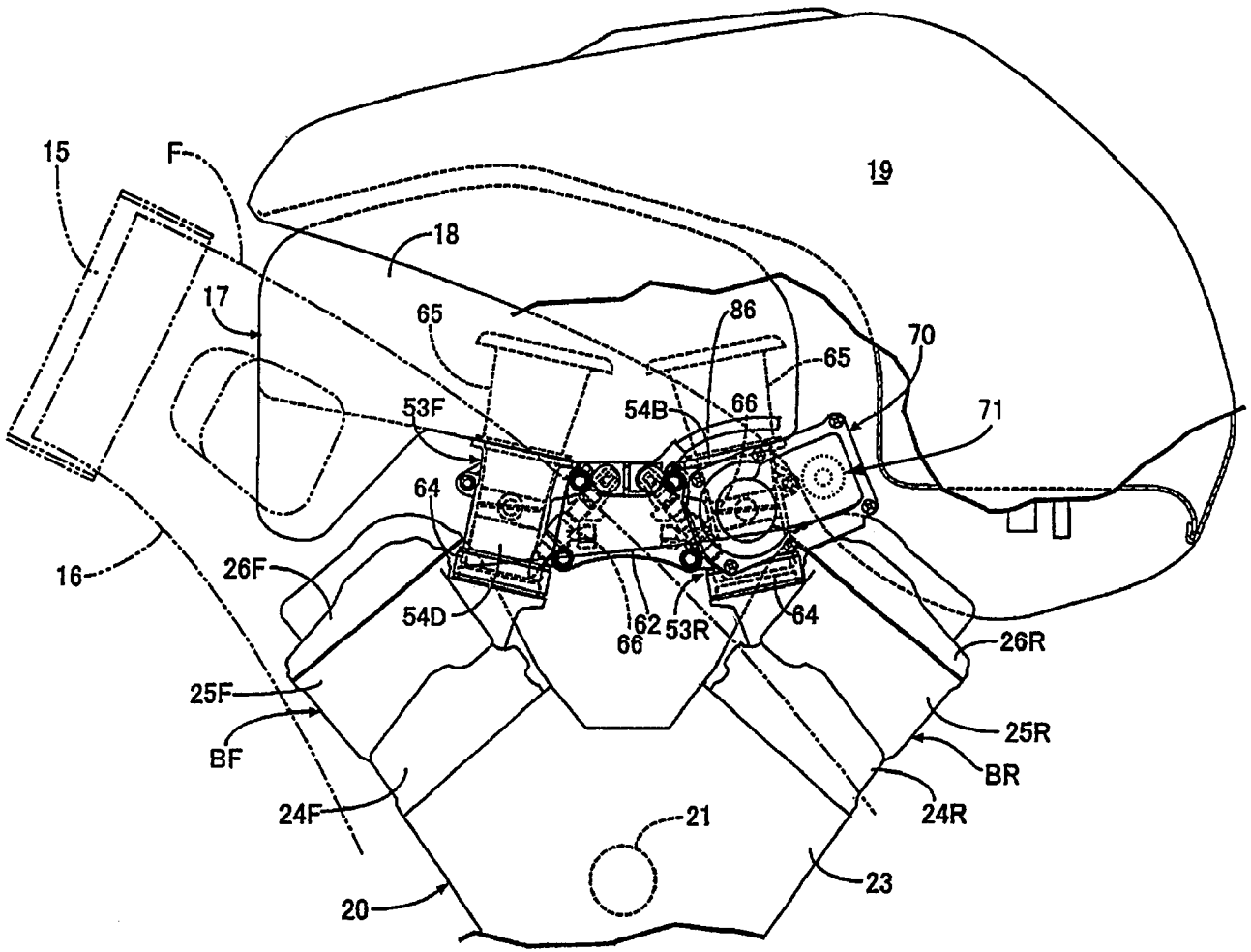
FIG. 1 is a vertical cross-sectional side view of a chief section of a motorcycle, which is obtained when viewed from the left.
Figure 2:
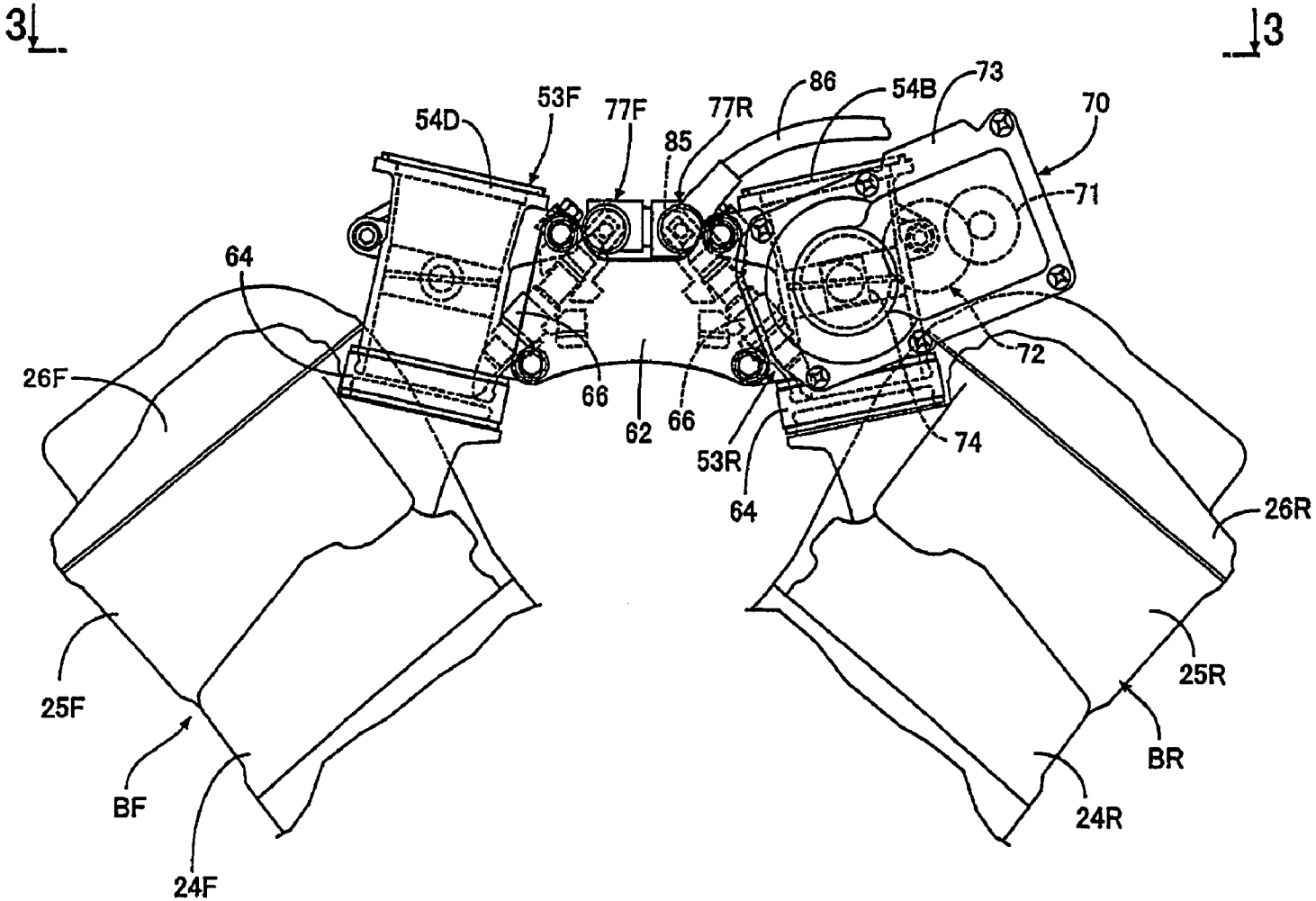
FIG. 2 is a magnified detail view of the chief section shown in FIG. 1.
Figure 3:
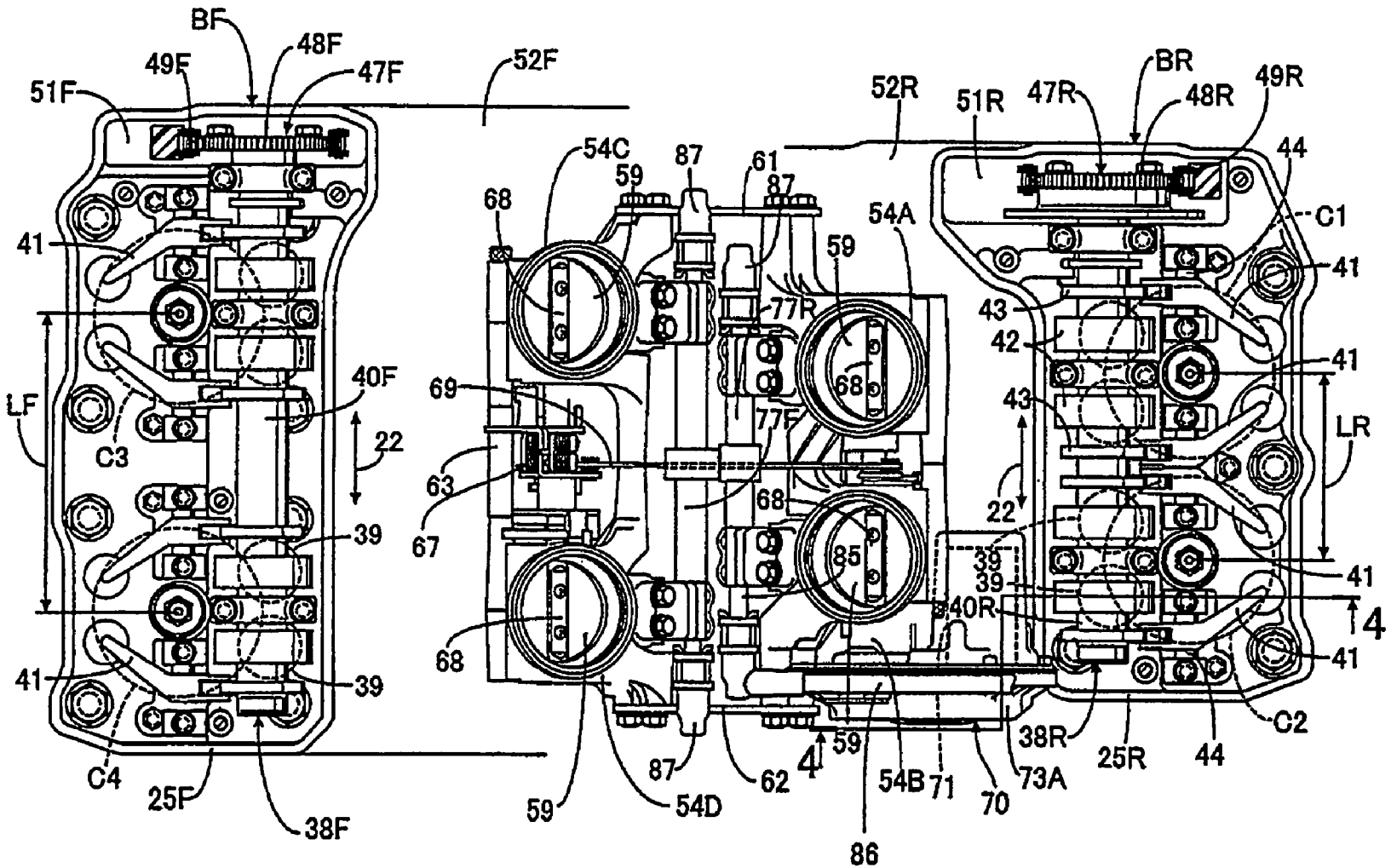
FIG. 3 is an auxiliary plan view of the chief section taken along the 3-3 line of FIG. 2, from which an illustration of a head cover is omitted.
Figure 4:
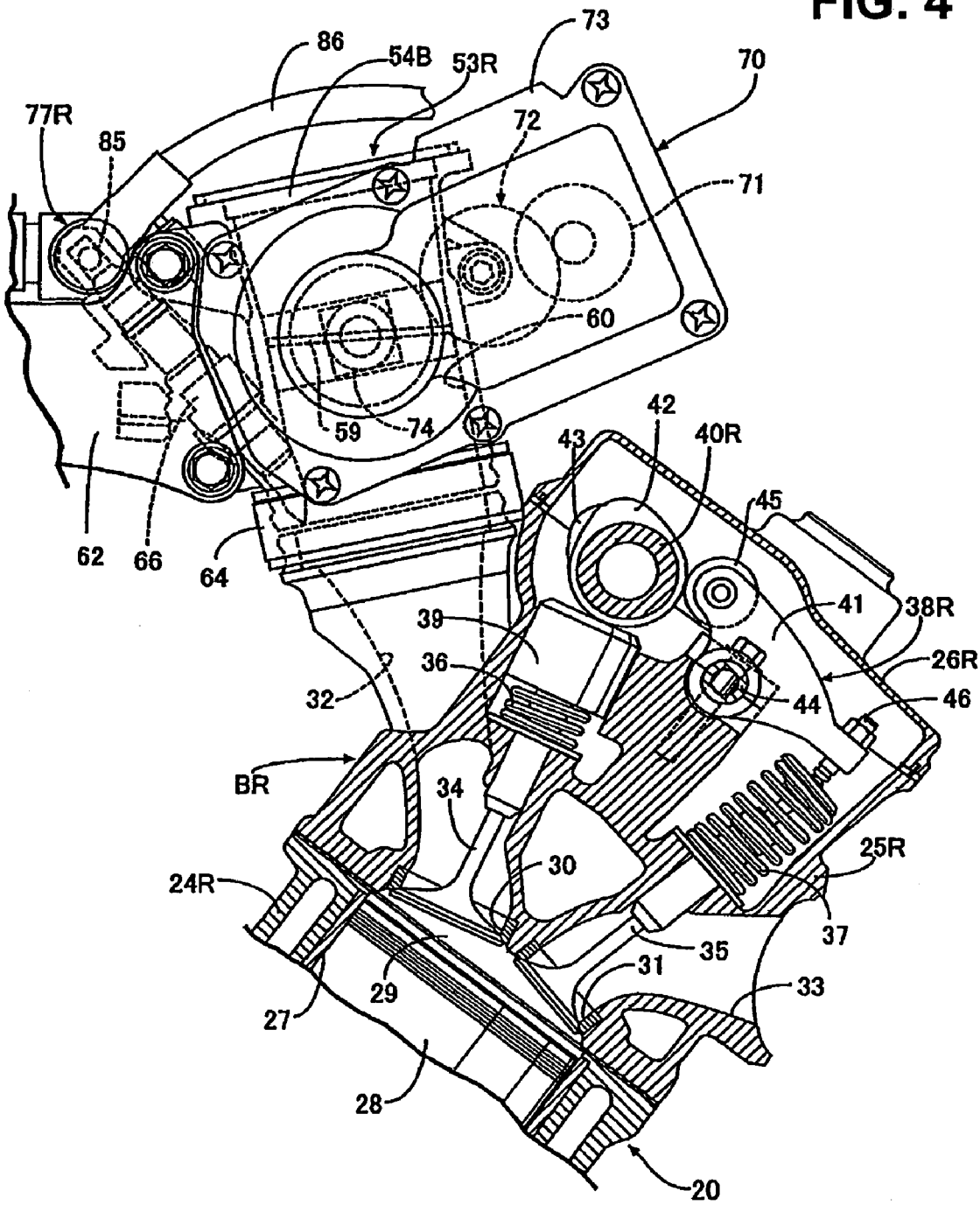
FIG. 4 is a magnified cross-sectional view of the chief section taken along the 4-4 line of FIG. 3.
Figure 5:
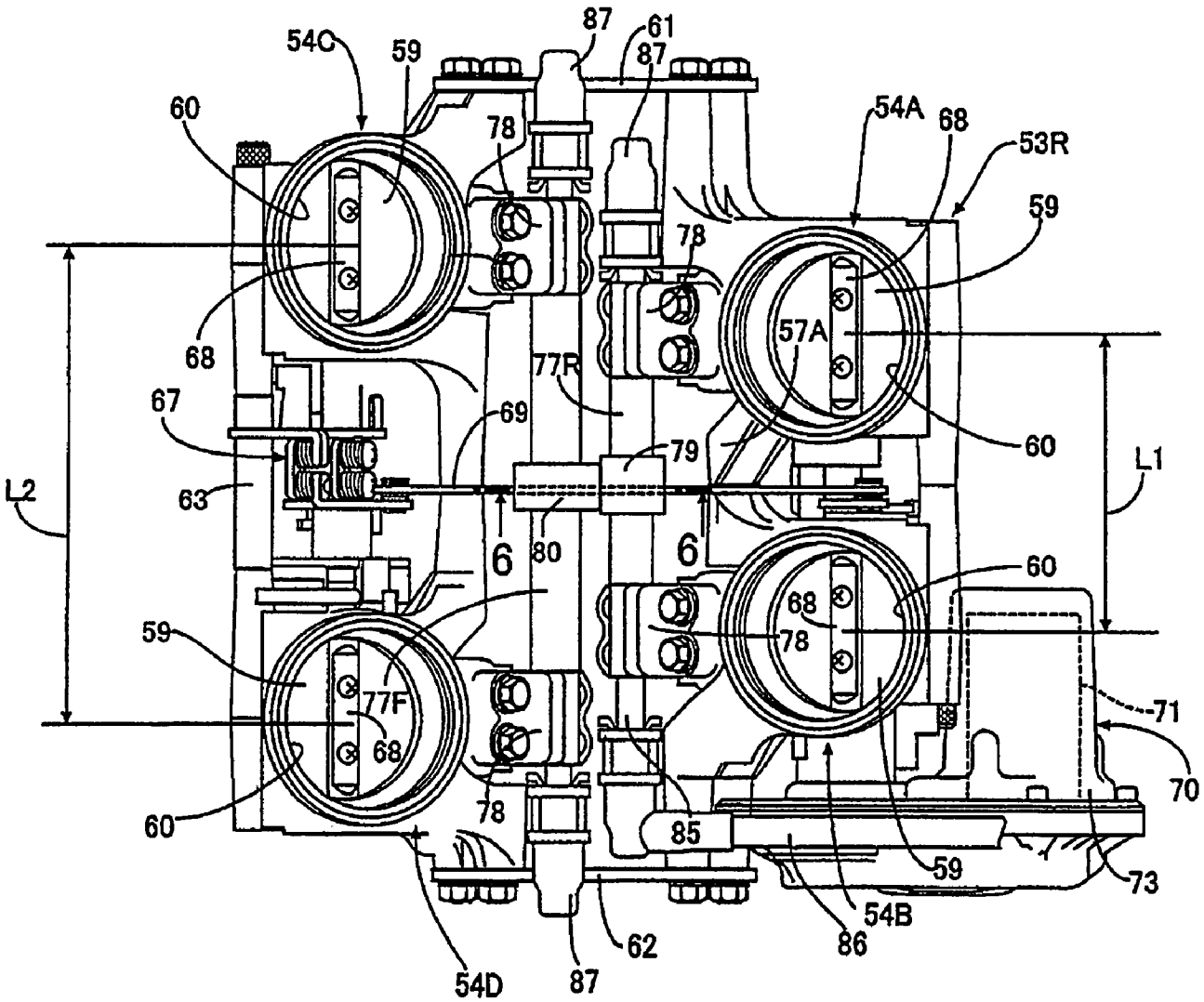
FIG. 5 is a magnified view of the chief section shown in FIG. 3.
Figure 6:
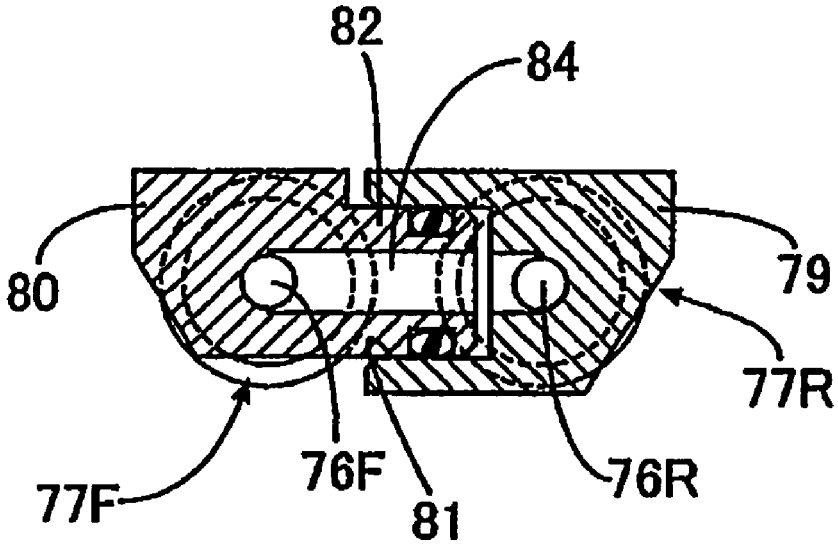
FIG. 6 is a magnified cross-sectional view of the chief section shown in FIG. 5.

FIGS. 1 to 6 show the embodiment of the present invention. FIG. 1 is a vertical cross-sectional side view of a chief section of a motorcycle, which is obtained when viewed from the left. FIG. 2 is a magnified view of the chief section shown in FIG. 1. FIG. 3 is an auxiliary plan view of the chief section taken along the 3-3 line of FIG. 2, from which an illustration of a head cover is omitted. FIG. 4 is a magnified cross-sectional view of the chief section taken along the 4-4 line of FIG. 3. FIG. 5 is a magnified view of the chief section shown in FIG. 3. FIG. 6 is a magnified cross-sectional view of the chief section taken along the 6-6 line of FIG. 5.

First of all, a vehicle body frame F of a motorcycle in FIG. 1 includes: a head pipe 15 disposed on a front end of the vehicle body frame F; and paired right and left main frames 16, each extending downward from the head pipe 15 to the rear thereof. A cleaner case 18 of an air cleaner 17 is supported above the two main frames 16. A fuel tank 19 is disposed in a way that the fuel tank 19 covers the cleaner case 18 from above. In addition, an engine main body 20, which is of a V4 cylinder engine mounted on the vehicle body frame F, is placed under the air cleaner 17.

As shown in FIGS. 2 and 3 together, the engine main body 20 includes a rear bank BR as a first bank and a front bank BF as a second bank. The rear bank BR and the front bank BF are separate from each other in the front-rear direction of the motorcycle, and are arranged in a V shape. The rear bank BR includes two cylinders C1 and C2 arranged side-by-side in the right-left direction of the vehicle body frame F, and the front bank BF includes two cylinders C3 and C4 arranged side-by-side in the right-left direction of the vehicle body frame F. In other words, the rear bank BR includes first and second cylinders C1 and C2 arranged side-by-side in a cylinder arrangement direction 22, which is equal to the right-left direction of the vehicle body frame F, and the front bank BF includes a third and fourth cylinders C3 and C4 arranged side-by-side in the cylinder arrangement direction 22. The lower portions, respectively, of the rear bank BR and the front bank BF, are commonly connected to a crankcase 23, which rotatably supports a crankshaft 21 having an axis extending in the width direction of the vehicle body frame F, or an axis extending in the cylinder arrangement direction 22.

The rear bank BR includes: a cylinder block 24R, which inclines upward to the rear and which is connected to the crankcase 23; a cylinder head 25R connected to the cylinder block 24R; and a head cover 26R connected to the cylinder head 25R. The front bank BF includes: a cylinder block 24F, which inclines upward to the front and which is connected to the crankcase 23; a cylinder head 25F connected to the cylinder block 24F; and a head cover 26F connected to the cylinder head 25F.

As shown in FIG. 3, the interval LR between the first and second cylinders C1 and C2 in the rear bank BR is set shorter than the interval LF between the third and fourth cylinders C3 and C4 in the front bank BF. Accordingly, the width, of the rear bank BR, in the axis direction of the crankshaft 21 is narrower than the corresponding width of the front bank BF, so the rear bank BR is hidden behind the front bank BF when viewed from the front.

For each of the cylinders C1 and C2, as shown in FIG. 4, a combustion chamber 29, in which the top of a piston 28 slidably fitted into a cylinder bore 27 provided to the cylinder block 24R faces, is formed between the cylinder block 24R and the cylinder head 25R in the rear bank BR. Likewise, for each of the cylinders C3 and C4, as shown in FIG. 4, a combustion chamber 29, in which the top of a piston 28 slidably fitted into a cylinder bore 27 provided to the cylinder block 24F faces, is formed between the cylinder block 24F and the cylinder head 25F in the front bank BF.

In the cylinder head 25R in the rear bank BR, an intake valve port 30 and an exhaust valve port 31, which are capable of communicating with the combustion camber 29, are provided in pairs to each of the cylinders C1 and C2. Likewise, in the cylinder head 25F in the front bank BF, an intake valve port 30 and an exhaust valve port 31, which are capable of communicating with the combustion camber 29, are provided in pairs to each of the cylinders C3 and C4. For the cylinders C1 and C2, an intake port 32, communicating commonly with the intake valve port 30 thus paired, is open to the front side of the cylinder head 25R in a way that the intake port 32 faces a V-shaped space created between the rear bank BR and the front bank BF. Likewise for the cylinders C3 and C4, an intake port 32, communicating commonly with the intake valve port 30 thus paired, is open to the rear side of the cylinder head 25F in a way that the intake port 32 faces a V-shaped space created between the rear bank BR and the front bank BF. For the cylinders C1 and C2, an exhaust port 33, communicating commonly with the exhaust valve port 31 thus paired, is open to the rear side of the cylinder head 25R. Likewise for the cylinders C3 and C4, an exhaust port 33, communicating commonly with the exhaust valve port 31 thus paired, is open to the front side of the cylinder head 25F.

In addition, intake valves 34 for opening and closing the respective intake valve ports 30, as well as exhaust valves 35 for opening and closing the respective exhaust valve ports 31, are placed in each of the cylinder heads 25R and 25F in a way that the intake valves 34 and the exhaust valves 35 are capable of opening and closing. Each intake valve 34 is biased by a valve spring 36 in the same direction as the intake valve 34 closes, and each exhaust valve 35 is biased by a valve spring 37 in the same direction as the exhaust valve 35 closes.

A first valve system 38R, for driving the intake valve 34 and the exhaust valve 35 to open and close, is housed between the cylinder head 25R and the head cover 26R in the rear bank BR. The intake valve 34 and the exhaust valve 35 are placed in pairs in each of the first and second cylinders C1 and C2 in the cylinder head 25R in the way that the intake valve 34 and the exhaust valve 35 are capable of opening and closing.

The first valve system 38R includes: valve lifters 39, each of which is formed in the shape of a closed-end cylinder with its top end being closed, and each of which is slidably fitted into the cylinder head 25R in a way that the top end of a corresponding one of the intake valves 34 abuts on the top end inner surface of the valve lifter 39; a camshaft 40R arranged above the valve lifters 39; and rocker arms 41 for driving the respective exhaust valves 35 to open and close while the rocker arms 41 swing through the driving, coupled with the rotation of the camshaft 40R.

The camshaft 40R has an axis which extends in parallel to the crankshaft 21, and is rotatably supported by the cylinder head 25R. Intake cams 42 provided to this camshaft 40R abut on the top end outer surfaces of the valve lifters 39, respectively. In addition, the rocker arms 41 each have an axis which extends in parallel to the camshaft 40R. For each exhaust valve 35, the rocker arm 41 is swingably supported by a corresponding one of the respective rocker shafts 44 which are fixedly supported by the cylinder head 25R. A roller 45 in rolling contact with a corresponding one of exhaust cams 43 provided to the camshaft 40R is pivotally supported by an end portion of each rocker arm 41. A tappet screw 46 screwed to the other end portion of each rocker arm 41 in a way that an advancement and retreat positions of the tappet screw 46 are capable of being controlled abuts on the top end of a corresponding one of the exhaust valve 35.

A second valve system 38F housed between the cylinder head 25F and the head cover 26F in the front bank BF includes: valve lifters 39 slidably fitted into the cylinder head 25F; a camshaft 40F arranged above the valve lifters 39; and rocker arms 41 for driving the respective exhaust valves 35 to open and close while the rocker arms 41 swing through driving coupled with the rotation of the camshaft 40F. The second valve system 38F is configured in the same manner as the first valve system 38R.

As shown in FIG. 3, a first timing transmission mechanism 47R is provided between the camshaft 40R in the first valve system 38R and the crankshaft 21, and a second timing transmission mechanism 47F is provided between the camshaft 40F in the second valve system 38F and the crankshaft 21.

The first timing transmission mechanism 47R is configured by looping an endless cam chain 49R around a driven sprocket 48R, fixed to an end of the camshaft 40R in the first valve system 38R, and a driving sprocket (not illustrated) provided to the crankshaft 21. In the present embodiment, the end of the camshaft 40R is the right end of the camshaft 40R when the engine main body 20 is mounted on the motorcycle. The first timing transmission mechanism 47R transmits the rotary power of the crankshaft 21 to the camshaft 40R while decelerating the rotary power to its half.

The second timing transmission mechanism 47F is configured by looping an endless cam chain 49F around a driven sprocket 48F, fixed to an end of the camshaft 40F in the second valve system 38F, and a driving sprocket (not illustrated) provided to the crankshaft 21. In the present embodiment, the end of the camshaft 40F is the right end of the camshaft 40F when the engine main body 20 is mounted on the motorcycle. The second timing transmission mechanism 47F transmits the rotary power of the crankshaft 21 to the camshaft 40F while decelerating the rotary power to its half.

A cam chain chamber 51R, in which the cam chain 49R of the first timing transmission mechanism 47R is allowed to run, is formed in the cylinder block 24R and the cylinder head 25R in the rear bank BR. A cam chain chamber 51F, in which the cam chain 49F of the second timing transmission mechanism 47F is allowed to run, is formed in the cylinder block 24F and the cylinder head 25F in the front bank BF. In addition, a swelling-out part 52R which swells out frontward is formed in an end portion of each of the cylinder block 24R and the cylinder head 25R in the rear bank BR, the end portion being that of the side where the first timing transmission mechanism 47R is arranged. In the case of the present embodiment, the end portion is the right end portion of each of the cylinder block 24R and the cylinder head 25R. A swelling-out part 52F which swells out rearward is formed in an end portion of each of the cylinder block 24F and the cylinder head 25F in the front bank BF, the end portion being that of the side where the second timing transmission mechanism 47F is arranged. In the case of the present embodiment, the end portion is the right end portion of each of the cylinder block 24F and the cylinder head 25F.

As also shown in FIG. 5, a first throttle body group 53R in the side of the rear bank BR and a second throttle body group 53F in the side of the front bank BF are arranged in a space between the rear bank BR and the front bank BF.

The first throttle body group 53R is configured by arranging the first and second throttle bodies 54A and 54B side-by-side in the cylinder arrangement direction 22, the first and second throttle bodies 54A and 54B, respectively corresponding to the first and second cylinders C1 and C2 arranged side-by-side in the cylinder arrangement direction 22 in the side of the rear bank BR. The second throttle body group 53F is configured by arranging the third and fourth throttle bodies 54C and 54D side-by-side in the cylinder arrangement direction 22, the third and fourth throttle bodies 54C and 54D, respectively corresponding to the third and fourth cylinders C3 and C4 arranged side-by-side in the cylinder arrangement direction 22 in the side of the front bank BF.

Each of the first to fourth throttle bodies 54A to 54D has a throttle bore 60. Throttle valves 59 for controlling the openings of the throttle bores 60 are rotatably supported by the throttle bodies 54A to 54D, respectively.

The first throttle body group 53R is configured by connecting the first throttle body 54A to the second throttle body 54B. The second throttle body group 53F is configured by connecting the third throttle body 54C to the fourth throttle body 54D. The distance L1 between the centers of the respective throttle bores 60 in the first and second throttle bodies 54A and 54B in the first throttle body group 53R is set equal to the interval LR between the first and second cylinders C1 and C2 in the rear bank BR corresponding to the interval LR. The distance L2 between the centers of the respective throttle bores 60 in the third and fourth throttle bodies 54C and 54D in the second throttle body group 53F is set equal to the interval LF between the third and fourth cylinders C3 and C4 in the front bank BF corresponding to the interval LF.

In other words, the distance L1 between the centers, respectively, of the throttle bores 60 in the throttle bodies 54A and 54B located in the two ends of the first throttle body group 53R in the cylinder arrangement direction 22, is set shorter than the distance L2 between the centers of the throttle bores 60 in the throttle bodies 54C and 54D located in the two ends of the second throttle body group 53F in the cylinder arrangement direction 22.

In addition, the two ends of the first throttle body group 53R in the cylinder arrangement direction 22 are connected to the two ends of the second throttle body group 53F in the cylinder arrangement direction 22 by the paired side plates 61 and 62 which extend in a direction orthogonal to the cylinder arrangement direction 22, respectively. In the present embodiment, the first throttle body 54A in the first throttle body group 53R and the third throttle body 54C in the second throttle body group 53F are connected to each other by the side plate 61, the second throttle body 54B in the first throttle body group 53R and the fourth throttle body 54D in the second throttle body group 53F are connected to each other by the side plate 62. Furthermore, the third and fourth throttle bodies 54C and 54D in the second throttle body group 53F are connected to each other with a spacer 63 interposed in between.

The throttle bodies 54A and 54B in the first throttle body group 53R are connected to the cylinder head 25R with an insulator 64 interposed in between, and the throttle bodies 54C and 54D in the second throttle body group 53F are connected to the cylinder head 25F with an insulator 64 interposed in between. In this way, the downstream ends, respectively, of the throttle bores 60 of the throttle bodies 54A and 54B, communicate with the intake port 32 of the cylinder head 25R, and the downstream ends, respectively, of the throttle bores 60 of the throttle bodies 54C and 54D, communicate with the intake port 32 of the cylinder head 25F.

Moreover, an air intake funnel 65, whose downstream end communicates with the upstream end of the throttle bore 60, is connected to in each of the respective throttle bodies 54A to 54D. The upstream ends of the respective air intake funnels 65 protrude into the cleaner case 18 so that the upstream ends of the air intake funnels 65 can communicate with a cleaning chamber in the air cleaner 17.

The valve shafts 68 of the two respective throttle valves 59 in the second throttle body group 53F are arranged coaxially and are linked and connected to each other with a linkage mechanism 67 interposed in between. In addition, the valve shafts 68 of the two respective throttle valves 59 in the first throttle body group 53R are coaxially linked and connected to each other. The linkage mechanism 67 is linked and connected to the valve shafts 68 of the two respective throttle valves 59 in the first throttle body group 53R with a link 69 interposed in between. In other words, in the depicted embodiment, the throttle valves 59 in the first and second throttle body groups 53R and 53F are concurrently and simultaneously opened and closed through their connecting linkage.

The throttle valves 59 in the first and second throttle body groups 53R and 53F are driven to open and close by throttle driving mechanism 70. This throttle driving mechanism 70 includes: an electric motor 71 for generating power for driving the throttle valves 59 to open and close; and a transmission mechanism 72 for decelerating the power coming from the electric motor 71, and thereafter for transmitting the resultant power to one of the valve shafts 68. The throttle driving mechanism 70 is housed in a casing 73.

The throttle driving mechanism 70 is placed in the side of the first throttle body group 53R and is arranged in a side which is opposite to the side where the first timing transmission mechanism 47R is located. The casing 73 is attached to the second throttle body 54B in the first throttle body group 53R.

The electric motor 71 has an axis which extends in the cylinder arrangement direction 22. As shown in FIG. 3, the electric motor 71 is arranged between the second throttle body 54B and the cylinder head 25R in a plan view. Furthermore, as shown in FIG. 1, the electric motor 71 is arranged under a space created between the cleaner case 18 of the air cleaner 17 and the fuel tank 19.

The transmission mechanism 72 is a reduction gear mechanism composed of multiple gears meshing with one another. The transmission mechanism 72 is interposed between the valve shaft 68 of the second throttle body 54B in the first throttle body group 53R and the electric motor 71. In addition, an opening sensor 74 (see FIGS. 2 and 4) for detecting the amount of rotation of the valve shaft 68 of the second throttle body 54B, or the opening of each throttle valve 59, is housed in the casing 73.

A first fuel supplying conduit 77R is connected to a fuel injection valve 66 of the first throttle body group 53R, and a second fuel supplying conduit 77F is connected to the a injection valve 66 of the second throttle body group 53F.

The first and second fuel supplying conduits 77R and 77F are arranged in parallel to each other in the cylinder arrangement direction 22. Supporting members 78 for supporting these fuel supplying conduits 77R and 77F are attached to each of the throttle bodies 54A to 54D. As shown in FIG. 6, the middle portions, respectively, of the first and second fuel supplying conduits 77R and 77F in their longitudinal directions are connected to each other. Specifically, a connecting tube part 79, which includes a fitting concave part 81 and which is open to the side of the second fuel supplying line 76F, is provided to the middle portion of the first fuel supplying line 76R. A connecting tube part 80, including a fitting protrusion part 82 which fluid-tightly fits into the fitting concave 81, is provided to the middle portion of the second fuel supplying conduit 77F. Thus, with the fitting protrusion part 82 being fluid-tightly fitted into the fitting concave part 81, the connecting tube parts 79 and 80 together form a communicating line 84. The communicating line 84 causes the first fuel supplying line 76R, which extends in the cylinder arrangement direction 22 and which is formed in the first fuel supplying conduit 77R, to communicate with the second fuel supplying line 76F, which extends in the cylinder arrangement direction 22 and which is formed in the second fuel supplying conduit 77F.

As shown in FIG. 3, a joint part 85 to which a fuel hose 86 is connected is provided to an end of the first fuel supplying conduit 77R corresponding to the first throttle body group 53R, in which the distance L1 between the throttle bores 60, respectively, of the neighboring first and second throttle bodies 54A and 54B, is set shorter than the distance between the throttle bores 60, respectively, of the neighboring throttle bodies 54C and 54D in the second throttle body group 53F. In the case of the present embodiment, the end of the first fuel supplying conduit 77R is the left end of the first fuel supplying conduit 77R. This joint part 85 is arranged between the paired right and left side plates 61 and 62, which connect the first and second throttle body groups 53R and 53F.

In addition, the joint part 85 is formed in a way that the joint part 85 is detachably connected to the fuel hose 86 extending in the longitudinal direction of the first fuel supplying conduit 77R by an insertion/detachment operation of the fuel hose 86. Out of the two side plates 61 and 62, the side plate 62 located in the side where the joint part 85 is arranged is formed in a way that the joint part 85 is exposed to the outside when viewed in the longitudinal direction of the first fuel supplying conduit 77R. In the present embodiment, the side plate 62 is formed in a way that a part of the top portion of the side plate 62 is recessed. Furthermore, the other end of the first fuel supplying conduit 77R and the two ends of the second fuel supplying conduit 77F are closed fluid-tightly with a cap 87.

Next, descriptions will be provided for operations of the present embodiment. The distance L1 between the throttle bores 60 of the respective throttle bodies 54A and 54B located in the two ends of the first throttle body group 53R in the cylinder arrangement direction 22 is set shorter than the distance L2 between the throttle bores 60 of the respective throttle bodies 54C and 54D located in the two ends of the second throttle body group 53F in the cylinder arrangement direction 22. In addition, out of the first and second fuel supplying conduits 77R and 77F connected to each other in order that the first and second fuel supplying lines 76R and 76F can communicate with each other, the first fuel supplying conduit 77R corresponds to the first throttle body group 53R. The joint part 85, to which the fuel hose 86 is connected, communicating with the first fuel supplying line 76R is provided to an end of the first fuel supplying conduit 77R in the way that the joint part 85 is arranged between the paired right and left side plates 61 and 62 for connecting the first and second throttle body groups 53R and 53F to each other.

As a result, in the present embodiment, it is possible to avoid interference between the joint part 85 and the other component parts, and thus, to increase freedom in arranging those component parts, as well as accordingly to arrange those component parts around the V-type multi-cylinder engine easily, functionally and compactly.

In addition, in the present embodiment, it is easy to detachably connect the fuel hose 86 to the joint part 85 with an insertion/detachment operation of the fuel hose 86, and thus (it is possible) to increase the productivity and maintenanceability. This is because the joint part 85 is formed in a way that the joint part 85 is detachably connected to the fuel hose 86 extending in the longitudinal direction of the first fuel supplying line 76R with an insertion/detachment operation of the fuel hose 86, and also because, out of the two side plates 61 and 62, the side plate 62 located in the same side as the joint part 85 (is arranged) is formed in a way that the joint part 85 is exposed to the outside when viewed in the longitudinal direction of the first fuel supplying line 76R.

Furthermore, in the present embodiment, it is possible to easily protect the connecting part between the two fuel supplying conduit 77R and 77F. This is because the first and second fuel supplying conduits 77R and 77F are connected to each other at their center portions in the longitudinal directions of the fuel supplying conduits 77R and 77F.

Also, in the present embodiment, it is possible to place the electric motor 71 close to the cylinder head 25R to the maximum possible extent without considering interference which would otherwise occur between the electric motor 71 and the first timing transmission mechanism 47R, and thus, to construct the intake charge regulating apparatus compactly. This is because the throttle driving mechanism 70 is arranged in the side which is opposite to the side where the first timing transmission mechanism 47R is located in the axis direction of the crankshaft 21, and also because the electric motor 71 is arranged between the second throttle body 54B and the cylinder head 25R in a plan view.

Moreover, in the present embodiment, it is possible to effectively arrange the throttle driving mechanism 70 in the space created by comparatively narrowing down the interval between the first and second throttle bodies 54A and 54B in the first throttle body group 53R. This is because the throttle driving mechanism 70 is placed in the first throttle body group 53R in which the distance L1 between the throttle bores 60, respectively, of the first and second throttle bodies 54A and 54B, is shorter than the distance between the throttle bores 60, respectively, of the third and fourth throttle bodies 54C and 54D in the second throttle body group 53F.

The present invention has been described by an explanation of selected illustrative embodiments. However, the present invention is not limited to the embodiment provided. It is possible to apply various design modifications to the present invention without departing from the present invention as recited in the scope of claims.

What is claimed is:

1. In an engine having a plurality of cylinders, a crankcase rotatably supporting a crankshaft and a camshaft therein, and a timing transmission mechanism interconnecting the camshaft and the crankshaft and including a camshaft sprocket mounted on one end of the camshaft included in a valve train for driving intake valves and exhaust valves to open and close in respective cylinder heads of the engine during operation thereof, the improvement comprising an intake charge regulating apparatus for the engine, the intake charge regulating apparatus comprising:

a plurality of throttle bodies including a first throttle body having a first throttle bore formed therein for communicating with an intake port of a first cylinder head, and a first throttle valve disposed in the first throttle bore for controlling an opening of the first throttle bore, the plurality of throttle bodies also including a second throttle body having a second throttle bore formed therein for communicating with an intake port of a second cylinder head, and a second throttle valve disposed in the second throttle bore for controlling an opening of the second throttle bore;

a throttle driving mechanism including an electric motor for generating power for driving the first throttle valve to open and close, and a transmission mechanism for decelerating a driving force of the electric motor, and for transmitting the driving force to the first throttle valve;

wherein the throttle driving mechanism is arranged at a side of the engine which is opposite to the camshaft sprocket in an axis direction of the crankshaft; and wherein the electric motor is arranged between the first throttle body and the first cylinder head as seen in a top plan view.

2. The intake charge regulating apparatus for an engine as recited in claim 1, wherein:

the engine is a four cylinder engine with first and second banks arranged substantially in a V shape, two throttle bodies including the first throttle body are arranged respectively corresponding to two cylinders in the first bank, and the two throttle bodies are connected to each other so that the two throttle bodies constitute a first throttle body group, two other throttle bodies arranged respectively corresponding to two cylinders in the second bank are connected to each other in order that the two other throttle bodies constitute a second throttle body group, a distance between the throttle bores of the two respective throttle bodies in the first throttle body group is set shorter than a distance between the throttle bores of the two throttle bodies in the second throttle body group, and the electric motor is situated proximate the first throttle body group.

3. The intake charge regulating apparatus for an engine as recited in claim 2, wherein:

the engine is mounted on a vehicle body frame of a motorcycle while being arranged under an air cleaner and a fuel tank, and the electric motor is arranged under a space created between a housing of the air cleaner and the fuel tank.

4. The intake charge regulating apparatus for an engine as recited in claim 2, further comprising a connecting linkage extending between the throttle valves of the first and second throttle body groups, such that the first and second throttle body groups are concurrently and simultaneously opened and closed through their connecting linkage.

5. The intake charge regulating apparatus for an engine as recited in claim 1, further comprising a plurality of air intake funnels, wherein a respective one of said air intake funnels communicates with an upstream end of each of the respective throttle bodies.

6. The intake charge regulating apparatus for an engine as recited in claim 3, further comprising a plurality of air intake funnels, wherein a respective one of said air intake funnels communicates with an upstream end of each of the respective throttle bodies, and wherein upper ends of the air intake funnels are disposed inside of the air cleaner housing.

7. An intake charge regulating apparatus for a four cylinder engine with first and second banks arranged substantially in a V shape, the intake charge regulating apparatus comprising:

a first throttle body having a throttle bore formed therein for communicating with an intake port of a first cylinder head, and a throttle valve disposed in the throttle bore for controlling an opening of the throttle bore, wherein two throttle bodies including the first throttle body are arranged respectively corresponding to two cylinders in the first bank, and the two throttle bodies are connected to each other so that the two throttle bodies constitute a first throttle body group, two other throttle bodies are arranged respectively corresponding to two cylinders in the second bank are connected to each other in order that the two other throttle bodies constitute a second throttle body group;

a throttle driving mechanism including an electric motor for generating power for driving the throttle valve to open and close, and a transmission mechanism for decelerating a driving force of the electric motor, and for transmitting the driving force to the throttle valve, wherein:

a camshaft sprocket, which is part of a timing transmission mechanism for transmitting power from a crankshaft is fixed to an end portion of a camshaft included in a valve system for driving an intake valve and an exhaust valve to open and close in the cylinder head;

wherein the throttle driving mechanism is arranged at a side of the engine which is opposite to the camshaft sprocket in an axis direction of the crankshaft; and the electric motor is arranged between the first throttle body and the first cylinder head as seen in a top plan view;

wherein the engine is configured such that a distance between the throttle bores of the two respective throttle bodies in the first throttle body group is set shorter than a distance between the throttle bores of the two throttle bodies in the second throttle body group, and the electric motor is situated proximate the first throttle body group.

8. The intake charge regulating apparatus for an engine as recited in claim 7, wherein:

the engine is mounted on a vehicle body frame of a motorcycle while being arranged under an air cleaner and a fuel tank, and the electric motor is arranged under a space created between a housing of the air cleaner and the fuel tank.

9. The intake charge regulating apparatus for an engine as recited in claim 7, further comprising a connecting linkage extending between the throttle valves of the first and second throttle body groups, such that the first and second throttle body groups are concurrently and simultaneously opened and closed through their connecting linkage.

10. The intake charge regulating apparatus for an engine as recited in claim 7, further comprising a plurality of air intake funnels, wherein a respective one of said air intake funnels communicates with an upstream end of each of the respective throttle bodies.

11. The intake charge regulating apparatus for an engine as recited in claim 8, further comprising a plurality of air intake funnels, wherein a respective one of said air intake funnels communicates with an upstream end of each of the respective throttle bodies, and wherein upper ends of the air intake funnels are disposed inside of the air cleaner housing.

12. A four cylinder engine comprising:

first and second banks arranged substantially in a V shape;

first and second throttle body groups each comprising a plurality of throttle bodies, and a pair of spaced-apart side plates operatively interconnecting the first and second throttle body groups;

said first throttle body group comprising a first throttle body having a throttle bore formed therein for communicating with an intake port of a first cylinder head, and a throttle valve disposed in the throttle bore for controlling an opening of the throttle bore, wherein two throttle bodies including the first throttle body are arranged respectively corresponding to two cylinders in the first bank, and the two throttle bodies are connected to each other so that the two throttle bodies constitute the first throttle body group, two other throttle bodies are arranged respectively corresponding to two cylinders in the second bank are connected to each other in order that the two other throttle bodies constitute the second throttle body group;

a throttle driving mechanism including an electric motor for generating power for driving the throttle valve to open and close, and a transmission mechanism for decelerating a driving force of the electric motor, and for transmitting the driving force to the throttle valve, wherein:

a camshaft sprocket, which is part of a timing transmission mechanism for transmitting power from a crankshaft is fixed to an end portion of a camshaft included in a valve system for driving an intake valve and an exhaust valve to open and close in the cylinder head;

the throttle driving mechanism is arranged at a side of the engine which is opposite to the camshaft sprocket in an axis direction of the crankshaft;

the electric motor is arranged between the first throttle body and the first cylinder head as seen in a top plan view;

the engine is configured such that a distance between the throttle bores of the two respective throttle bodies in the first throttle body group is set shorter than a distance between the throttle bores of the two throttle bodies in the second throttle body group, and the electric motor is situated proximate the first throttle body group.

13. The engine as recited in claim 12, wherein:

the engine is mounted on a vehicle body frame of a motorcycle while being arranged under an air cleaner and a fuel tank, and the electric motor is arranged under a space created between a housing of the air cleaner and the fuel tank.

14. The engine as recited in claim 12, further comprising a connecting linkage extending between the throttle valves of the first and second throttle body groups, such that the first and second throttle body groups are concurrently and simultaneously opened and closed through their connecting linkage.

15. The engine as recited in claim 12, further comprising a plurality of air intake funnels, wherein a respective one of said air intake funnels communicates with an upstream end of each of the respective throttle bodies.

16. The engine as recited in claim 13, further comprising a plurality of air intake funnels, wherein a respective one of said air intake funnels communicates with an upstream end of each of the respective throttle bodies, and wherein upper ends of the air intake funnels are disposed inside of the air cleaner housing.

* * * * *